US005397110A

United States Patent [19]

Brezny et al.

[11] Patent Number: 5,397,110

[45] Date of Patent: Mar. 14, 1995

[54] REFRACTORY BRICK AND METHOD OF MAKING AND USING SAME

[75] Inventors: Bohus Brezny, State College, Pa.; David E. Shewmon, Cincinnati, Ohio

[73] Assignee: North American Refractories Company, Cleveland, Ohio

[21] Appl. No.: 14,632

[22] Filed: Feb. 8, 1993

[51] Int. Cl.[6] ..... C21B 7/04

[52] U.S. Cl. ..... 266/283; 266/280; 52/596; 52/600

[58] Field of Search ..... 266/280, 282, 283, 286; 52/596, 598, 600, 601, 602

[56] References Cited

U.S. PATENT DOCUMENTS

| | | | |
|---|---|---|---|
| 122,908 | 1/1872 | Perry | 266/282 |
| 2,216,813 | 10/1940 | Goldschmidt | 266/282 |
| 2,527,063 | 10/1950 | Heuer | 25/156 |
| 2,652,793 | 9/1953 | Heuer et al. | 110/99 |
| 2,759,723 | 8/1956 | Crespi | 266/43 |
| 2,791,116 | 5/1957 | Heuer et al. | 266/282 |
| 3,284,979 | 11/1966 | Edwards | 52/600 |
| 3,615,776 | 10/1971 | Farrington et al. | 106/59 |
| 3,698,068 | 10/1972 | Norris et al. | 29/509 |
| 3,781,962 | 1/1974 | Norris et al. | 29/200 |
| 3,832,478 | 8/1974 | Books | 13/35 |
| 3,852,080 | 12/1974 | Davies et al. | 106/58 |
| 4,196,894 | 4/1980 | Brezny | 266/282 |
| 4,609,338 | 9/1986 | Nishida et al. | 425/149 |
| 4,768,447 | 9/1988 | Roumeguere | 110/325 |
| 4,803,933 | 2/1989 | Carey, Jr. et al. | 110/338 |
| 4,809,645 | 3/1989 | Fournier et al. | 122/6 A |
| 4,974,666 | 12/1990 | Hirata et al. | 165/9.1 |
| 5,127,463 | 7/1992 | Hirata et al. | 165/9.1 |
| 5,154,224 | 10/1992 | Yasui et al. | 165/9.1 |

FOREIGN PATENT DOCUMENTS

| | | | |
|---|---|---|---|
| 0958188 | 5/1964 | United Kingdom | 52/596 |

*Primary Examiner*—Scott Kastler

*Attorney, Agent, or Firm*—Benesch, Friedlander, Coplan & Arnoff

[57] ABSTRACT

The present invention provides a new and improved refractory brick that provides many distinct advantages over prior art bricks. More particularly, the brick of the present invention facilitates the construction of an integral furnace lining that prevents the dislodgement or movement of individual bricks. The refractory brick of the present invention also provides a continuous refractory lining which affords improved lining lifetimes or furnace campaigns. Each brick comprises a refractory portion and a pair of steel portions. The steel portions are each contained within a recess formed along each of the major surfaces of the brick. The brick is utilized to form a refractory lining within a vessel wherein at least a part of the refractory portion of each brick is in contact with the refractory portion of adjoining bricks and the steel portions of each of the bricks is metallurgically bonded to the steel portions of adjoining bricks so as to provide an integral (monolithic) refractory wall.

20 Claims, 1 Drawing Sheet

REFRACTORY BRICK AND METHOD OF MAKING AND USING SAME

BACKGROUND OF THE INVENTION

1. Field of the Invention

This invention concerns a refractory brick for use in high-temperature vessels. More particularly, the invention concerns a refractory brick which can be utilized to produce an integral lining within a high-temperature vessel such as a furnace vessel.

2. State of the Art

The prior art provides various refractory bricks for use in a variety of vessels. These vessels include, for example, basic oxygen furnaces (BOF), electric arc furnaces, argon oxygen deoxidizing vessels (AOD) and vacuum degassing furnaces. Prior art refractory bricks may be either of a homogeneous type (i.e., comprising only refractory material) or they may be a composite type of brick (i.e., comprising refractory material and one or more additional materials such as steel).

An example of one prior art composite type refractory brick may be found in Brezny U.S. Pat. No. 4,196,894. Brezny '894 discloses a brick comprising a refractory material having internally and externally disposed steel elements. The steel elements serve to conduct heat away from the hot face of the brick.

Another prior art composite type refractory brick may be found in Books U.S. Pat. No. 3,832,478. Books '478 discloses a brick having a metal shell that covers a substantial part of the refractory portion of the brick. The Books '478 bricks are designed specifically for use in conjunction with a sprayed-on type of refractory material.

Yet another prior art composite type refractory brick may be found in Heuer U.S. Pat. No. 2,527,063. Heuer '063 discloses a brick having a metallic hanger insert embedded in the refractory portion of the brick. The hanger insert engages a hanger mounted along the outer wall of the vessel. The hanger and the hanger insert serve to retain the position of the bricks within the vessel.

SUMMARY OF THE INVENTION

The present invention provides a new and improved refractory brick that affords many distinct advantages over prior art bricks. More particularly, the brick of the present invention facilitates the construction of an integral furnace lining that prevents the dislodgement or movement of individual bricks. The ability to provide an integral wall is particularly significant during the deskulling of the cone area of a basic oxygen furnace. During deskulling operations the bricks in the cone area are subjected to excessive stress that tends to dislodge individual bricks. The ability to provide an integral wall is also significant in the high wear areas of a furnace, such as the trunnion area of a basic oxygen furnace lining. The present invention provides an integral lining without the use of hangers. Also, the meritorious brick of the present invention provides a continuous (monolithic) refractory lining which affords improved lining life, lower consumption of repair material, decreased refractory cost and longer furnace campaigns.

In one embodiment the refractory brick comprises a refractory portion and at least two sections of steel. The refractory portion has a first major surface and an opposed second major surface. Each of the major surfaces includes an outer wall encompassing a recessed portion.

The recessed portion includes a bottom wall and a side wall extending between the bottom wall and the outer wall. The recessed portions each contain one of the sections of steel. The steel sections, which preferably comprise a section of steel plate or strip, each include a first major face and an opposed second major face. The first major faces of the steel sections are in contact with the bottom walls of the recessed portions. The second major faces of the steel sections are substantially contiguous with the outer walls of the refractory portion.

When producing a refractory lining utilizing the brick of the present invention at least a part of the refractory portion of said bricks is in contact with the refractory portion of adjoining bricks and the steel portions of such bricks is metallurgically bonded to the steel portions of adjoining bricks.

The foregoing and other features of the invention are hereinafter more fully described and particularly pointed out in the claims. The following description sets forth in detail certain illustrative embodiments of the invention, those being indicative, however, of but a few of the various ways in which the principles of the invention may be employed.

DETAILED DESCRIPTION OF THE PREFERRED EMBODIMENTS

Figure 1:
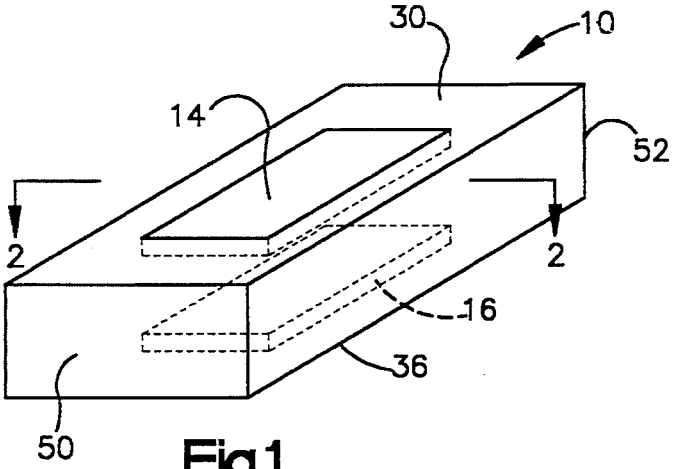
FIG. 1 is a perspective view of a refractory brick made in accordance with the principles of the present invention.
Figure 2:
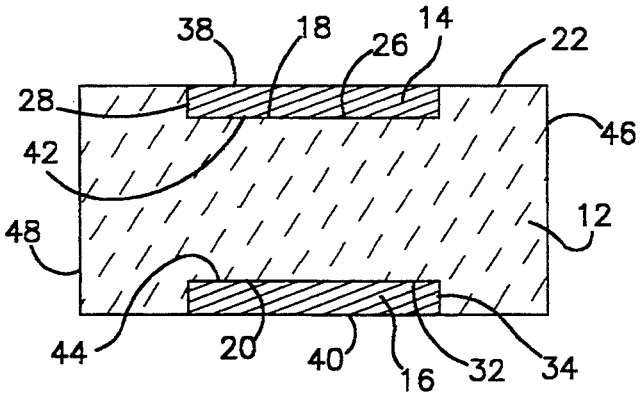
FIG. 2 is a cross-sectional view of the brick of FIG. 1 taken along line 2—2 thereof.

Referring to the drawings and initially to FIGS. 1 and 2 there is illustrated a refractory brick 10 made in accordance with the present invention. Brick 10 comprises a refractory portion 12 and a pair of steel sections 14 and 16. Top steel section 14 and bottom steel section 16 are respectively received within recesses 18 and 20 formed along the opposed major surfaces 22 and 24 of the refractory portion 12.

Top recess 18 is formed by a bottom wall 26 and a side wall 28 that extends substantially perpendicular to the bottom wall 26. Bordering recess 18 is an outer wall 30 that surrounds the entire perimeter of the steel section 14. Similarly, bottom recess 20 is formed by a bottom wall 32 and a side wall 34. Bordering recess 20 is an outer wall 36 that surrounds the entire perimeter of the steel section 16.

Steel sections 14 and 16 each include a first major face 38 and 40 and an opposed second major face 42 and 44. The outer first major faces 38 and 40 are substantially contiguous with the outer walls 30 and 36 of the refractory portion 12. The inwardly disposed major faces 42 and 44 are contiguous with the respective bottom walls 26 and 32 of recesses 18 and 20.

In addition to the top major surface 22 and opposed bottom major surface 24, brick 10 includes a right side surface 46 and a left side surface 48 and a front surface 50 and a rear surface 52. Front surface 50 forms the high temperature inner wall (hot face) of a refractory lining and rear surface 52 is positioned towards the outer wall of the vessel that is lined (cold face). Front surface 50 and rear surface 52 both extend substantially perpendicular to the longitudinal axis of the top major surface 22 and bottom major surface 24. Right side surface 46 and left side surface 48 both extend substantially perpendicular to the front surface 50 and the rear surface 52. It will be appreciated that in many applications it is desirable to provide the front surface 50 with a smaller width than the rear surface 52. This provides a tapered or keyed brick that facilitates the construction of a refractory lining inside a vessel.

Steel sections 14 and 16 comprise a section of steel sheet or plate. Preferably, steel sections 14 and 16 comprise a section of low carbon steel sheet or plate. Any number of low carbon steels may be utilized, such as, for example, SAE1010, SAE1015 or SAE1020 steel. Various sizes and thicknesses of plate or sheet may be employed.

Any number of conventional refractory materials may be utilized to produce the refractory portion 12. Preferably, the material composition that is utilized is one which protects the steel sections 14 and 16 from oxidation while the brick 10 is in service. A carbon containing refractory mix will protect the steel sections 14 and 16 against oxidation during service at high temperatures. The brick 10 may be produced by utilizing various conventional production techniques. One technique suitable for use in producing the brick 10 includes providing a mold having the desired shape. The bottom steel section 16 is then placed in the bottom of the mold such that the outer perimeter or outer edge 54 of the bottom steel section 16 is spaced from the sides of the mold. A refractory mix is then placed into the mold cavity. The top steel section 14 is then placed on top of the refractory mix. The top steel section 14 is aligned such that outer perimeter or outer edge 56 of the top steel section 14 is spaced from the sides of the mold. A production press with a flat head is then utilized to compress top steel section 14 into the refractory mix while making certain that the first major face 38 is level with the refractory body. Typically, a pressure of 4–10 tons/inch is utilized, the exact pressure required being primarily a function of the size of top steel section 14. The pressed refractory brick (green) is then cured so as to provide a fully hardened brick 10. The bricks 10 are fired under thermal and atmospheric conditions which protect the steel sections 14 and 16 against oxidation. Subsequent to firing the steel sections 14 and 16 are bonded to the refractory portion 12.

The major faces 38 and 40 of the steel sections 14 and 16 extend along from about 5% to about 90% of the major surfaces 22 and 24 of the refractory portion 12. Preferably, the major faces 38 and 40 of the steel sections 14 and 16 extend along from about 5% to about 85% of the major surfaces 22 and 24 of the refractory portion 12. More preferably, the major faces 38 and 40 of the steel sections 14 and 16 extend along from about 10% to about 80% of the major surfaces 22 and 24 of the refractory portion 12.

In some applications, for example in the trunnion area of the lining of a basic oxygen furnace vessel, it may be desirable to utilize steel sections with major faces 38 and 40 that extend along from less than about 50% of the major surfaces 22 and 24 of the refractory portion 12. In such situations, the steel sections are preferably spaced back from the hot face 50 of the refractory brick 10 and thus disposed primarily towards the cold end 52 of the brick 10. This type of configuration is believed to provide increased stability in high erosion areas such as the trunnion area of the lining of a basic oxygen furnace vessel.

Figure 2A:
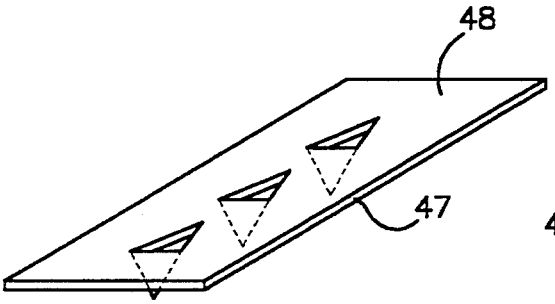
FIG. 2A is a perspective view of an alternative form of a steel section that may be utilized to produce a refractory brick made in accordance with the principles of the present invention.
Figure 2B:
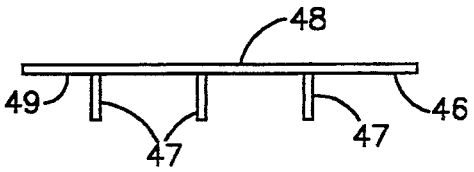
FIG. 2B is a side view of the steel section of FIG. 2A.

In order to promote adhesion between the steel sections 14 and 16, and the refractory portion 12, the first major faces 38 and 40 of the steel sections 14 and 16 may be provided with one or more protrusions so as to increase the surface area of the first major faces 38 and 40 and thus increase the area of contact between the steel sections 14 and 16 and the refractory portion 12. These protrusions may be, for example, semi-circular or triangular in shape. Referring to FIGS. 2A and 2B there is illustrated an alternative configuration for a steel section 46 that may be employed in the present invention instead of the continuously flat steel sections 14 and 16. Steel section 46 includes a plurality of triangular protrusions 47 that extend substantially perpendicular to the major faces 48 and 49 of steel section 46. Protrusions 47 are spaced equally along the longitudinal length of steel section 46. Protrusions 47 extend into the refractory portion of the brick thereby increasing the strength of the bond between the refractory portion and the steel section 46. Steel section 46 may be produced utilizing various techniques such as, for example, taking a flat plate of steel and punching the triangular projections or protrusions 47 into the plates.

Figure 3:
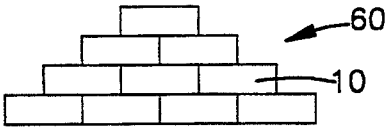
FIG. 3 is a front view of a portion of a refractory lining made using the brick of FIG. 1.
Figure 4:
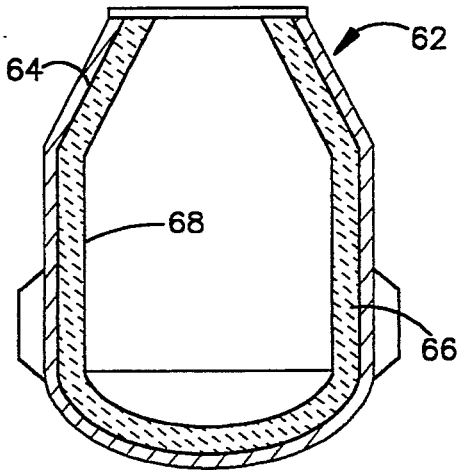
FIG. 4 is a schematic broken-away view of a basic oxygen furnace vessel in which multiple bricks like that shown in FIG. 1 have been employed.

Multiple refractory bricks 10 are utilized to form a refractory lining 60 as shown in FIG. 3 utilizing conventional techniques. Mortar may be used, but is not required. Lining 56 may form part of the inner refractory lining of a high temperature vessel such as a basic oxygen furnace vessel 62 as shown in FIG. 4.

Refractory lining 60 is formed initially in a conventional manner by stacking multiple bricks 10 as illustrated in FIG. 3. Because steel sections 14 and 16 do not protrude beyond the refractory portion 12 and are recessed within the refractory portion 12, bricks 10 form a continuous refractory surface (i.e., no gaps or spaces are formed between the bricks 10). Once the front hot faces 50 of the bricks are exposed to elevated temperatures, the steel sections 14 and 16 will metallurgically bond to the steel sections of adjoining bricks 10 thereby forming a single piece or integral (monolithic) lining. In order to form the metallurgical bond between the steel sections, the front hot faces 50 of the bricks 10 are exposed to a temperature of at least 2000° F. for a period of at least two hours. Preferably, the front hot faces 50 of the bricks 10 are exposed to a temperature of at least 2500° F. for a period of at least two hours. More preferably, the front hot faces 50 of the bricks 10 are exposed to a temperature of at least 2600° F. for a period of at least about two hours.

Depending on the type of vessel utilized, the front hot faces 50 of the bricks may be exposed to the elevated temperature necessary to effect a metallurgical bond in various ways. For example, in the vessel 62 of a basic oxygen furnace as shown in FIG. 4, if the lining 60 is utilized in the cone area 64 and the trunnion area 66, the front hot faces 50 of the bricks 10 that form the continuous refractory lining face 68 will be exposed to the required temperature during the initial burn-in period, and the subsequent blowing and tapping of vessel 62.

Depending on the extent of the initial burn-in, such initial burn-in in and of itself may be sufficient to cause a metallurgical bond to form between the steel sections of adjoining bricks.

The following examples will serve to illustrate the novel features and advantages of the present invention. Reference to the elements of FIGS. 1–4 have been made in order to facilitate a better understanding of the examples. While these examples will show one skilled in the art how to operate within the scope of the invention, they are not to serve as a limitation on the scope of the invention for such scope is only defined by the claims below.

EXAMPLE 1

Two types of refractory mixes, one containing a low carbon level (lamp black) and the other containing a high carbon level (graphite) were used to produce a refractory mix having the following compositions in weight percent.

| Constituent | Refractory Mix A | Refractory Mix B |
|---|---|---|
| Magnesia (97% Mgo) (−3+6 mesh) | 20% | — |
| Magnesia (97% MgO) (−6+14 mesh) | 30% | 50% |
| Magnesia (97% Mgo) (−14+48 mesh) | 27.5% | 20% |
| Magnesia (97% Mgo) (<48 mesh) | 5% | 5% |
| Magnesia (97% Mgo) BMF | 15% | 10% |
| Lamp Black | 2.5% | — |
| Graphite | — | 15% |
| Total | 100% | 100% |
| (Added) Resin[1] | 3% | 3% |
| (Added) Metallic Antioxidants[2] | 4% | 4% |

[1]Liquid novolak resin
[2]Metallic aluminum/magnesium mix

Bricks having the dimensions of 6″ tapered to 5″ width, 3″ height and 24″ length are produced utilizing Refractory Mix A in a mold using steel sections 14 and 16 having a thickness of 1 mm, a width of 4.5″ and a length of 22″. The steel sections 14 and 16 comprise SAE 1020 steel. Each section includes 5 triangular projections 47 substantially equally spaced along the central axis of the steel sections. A bottom steel section 16 is placed into and centered in the bottom of a mold with the projections facing up from the bottom of the mold. The mold is then substantially filled with Refractory Mix A and then a steel section is centered and placed on the top of the Mix A and pushed into the Mix A using a press such that the top of the steel section is substantially level with the top of Mix A, the projections extending into Mix A. The green bricks are then cured at 200° C. for 8 hours in a nonoxidizing atmosphere. The bricks made using Refractory Mix A are used in the cone area of the lining of a basic oxygen furnace vessel.

Bricks having the dimensions of 6″ tapered to 5″ width, 3″ height and 27″ length are produced utilizing Refractory Mix B in a mold using steel sections 14 and 16 having a thickness of 1 mm, a width of 4.5″ and a length of 6″. The steel sections 14 and 16 comprise SAE 1020 steel. Each of sections 14 and 16 includes triangular projections 47 substantially equally spaced along the central axis of the steel sections. A steel section is placed into the mold (projections facing up) such that it is spaced about 1″ from the end of the mold which will form the cold face of the brick and centered relative to the sides of the mold. The mold is substantially filled with Refractory Mix B and then a steel section is placed on top of the Mix B such that it is also spaced about 1″ from the end of the mold which will form the hot face of the brick and centered relative to the sides of the mold, the projections extending into Mix B. The top steel section is then pressed into Mix B using a press such that the upper surface of the steel section is substantially level with the top of Mix B. The green bricks are then cured at 180° C. for 6 hours in a nonoxidizing atmosphere. The bricks made using Refractory Mix B are then used in the trunnion area of the lining of a basic oxygen furnace vessel.

Other features and aspects of this invention will be appreciated by those skilled in the art upon reading and understanding this specification. Such features, aspects and expected variations and modifications are clearly within the scope of this invention, and this invention is limited solely by the scope of the following claims.

What is claimed:

1. A refractory brick for use in forming a lining for a vessel comprising a refractory portion and at least two sections of steel, said refractory portion having a first major surface and an opposed second major surface, each of said major surfaces includes an outer wall encompassing a recessed portion, said recessed portion comprising a bottom wall and a side wall extending between said bottom wall and said outer wall, said recessed portions each containing one of said sections of steel, said sections of steel each having a first major face and an opposed second major face, said first major faces of said steel sections being in contact with the bottom walls of said recessed portions, said side wall and said outer wall forming a boundary surrounding the entire perimeter of said steel section wherein said side wall is of sufficient thickness to substantially prevent oxidation of protected steel and said second major faces of said steel sections being substantially contiguous with the outer walls of said refractory portions.

2. A refractory brick as set forth in claim 1 wherein said side walls of said recesses extend substantially perpendicular to said outer walls.

3. A refractory brick as set forth in claim 1 wherein said side wall of said recesses extend substantially perpendicular to said bottom wall of said recesses.

4. A refractory brick as set forth in claim 1 wherein the major axis of said bottom walls of said recesses extend substantially parallel to said first and second major faces of said sections of steel.

5. A refractory brick as set forth in claim 1 wherein said sections of steel comprise low carbon steel.

6. A refractory brick as set forth in claim 1 wherein said sections of steel include multiple protrusions extending from one of said major faces of said sections of steel which serve to promote adhesion between said sections of steel and the refractory portion.

7. A refractory brick as set forth in claim 6 wherein said protrusions comprise triangular projections.

8. A refractory brick as set forth in claim 1 wherein said major faces of said sections of steel extend along from about 5% to about 90% of the major surfaces of said refractory portion.

9. A refractory brick as set forth in claim 8 wherein said major surfaces of said sections of steel extend along from about 5% to about 85% of the major surfaces of said refractory portion.

10. A method of producing a refractory brick comprising the steps of:

(A) providing a mold for forming the brick;

(B) providing a refractory mix;

(C) providing a first and a second section of steel;

(D) placing said first section of steel in said mold, the outer perimeter of said first section of steel being spaced from the sidewalls of said mold;

(E) filling said mold with said refractory mix;

(F) placing said second section of steel in said mold, the outer perimeter of said first section of steel being spaced from the sidewalls of said mold and the top surface of said second section of steel being substantially contiguous with the refractory mix wherein said first section and said second section of steel are substantially centered in said mold such that said mix forms a refractory side wall surrounding the entire perimeter of said sections of steel exposing only one surface of said sections of steel being substantially contiguous with the refractory mix wherein said side wall is of sufficient thickness to substantially prevent oxidation of protected steel; and (G) curing said refractory mix which contains said sections of steel.

11. A device for high temperature processing having a vessel, said vessel including a refractory lining comprising a first and a second refractory brick, said bricks each having a refractory portion and a steel portion, said steel portion being contained within a recess formed along a major surface of said bricks such that said bricks provide a continuous refractory inner lining, at least a part of said refractory portion of said first brick and at least a part of said refractory portion of said second brick being in contact, and said steel portion of said first brick and said steel portion of said second brick being joined by a metallurgical bond wherein each of said bricks further provide a side wall surrounding the entire perimeter of said steel section contained within a recess of said major surface of said bricks and said sidewall is of sufficient thickness to substantially prevent oxidation of protected steel.

12. A device as set forth in claim 1 wherein said first and second bricks each include a hot face, said faces being substantially contiguous to one another.

13. A device as set forth in claim 12 wherein at least a portion of said major surface of said first brick contacts one of said major surface of said second brick, and said steel portions of said bricks are spaced from said hot faces of said bricks.

14. A device as set forth in claim 12 wherein said device is selected from the group consisting of a basic oxygen furnace, an argon oxygen deoxidizing vessel, an electric furnace and a bottle car pig iron transport vessel.

15. A method of producing an integral refractory lining for a vessel comprising the steps of:

(A) providing a vessel;

(B) providing two or more refractory bricks for lining such vessel, such bricks each comprising a refractory portion and a steel portion, said bricks further comprising a refractory sidewall surrounding the entire perimeter of said steel portion which is contained in a recessed portion along a major surface of said brick and wherein said sidewall is of sufficient thickness to substantially prevent oxidation of protected steel, (C) stacking such first brick on top of such second brick such that at least a part of the refractory portion of such first brick is in contact with the refractory portion of such second brick and at least a part of such steel portion of such first brick is in contact with the steel portion of such second brick; and (D) subjecting such first and second brick to an elevated temperature so as to form a metallurgical bond between the steel portion of such first brick and the steel portion of such second brick.

16. A method of producing a lining as set forth in claim 15 wherein said refractory bricks are subjected to a temperature of at least 2000° F. for a period of at least two hours along at least one of the surfaces of the bricks.

17. A method of producing a lining as set forth in claim 14 wherein said steel portions of each of said bricks comprise a pair of steel sections.

18. A method of producing a lining as set forth in claim 17 wherein said bricks each include a first major surface and an opposed second major surface, said major surfaces each having a recess with one of said steel sections received therein.

19. A method of producing a lining as set forth in claim 18 wherein said bricks each include a hot face that forms the inner surface of said lining, said steel sections being spaced from said hot faces.

20. A method of producing a lining as set forth in claim 18 wherein said steel sections extend along from about 10% to about 80% of said major surfaces.

* * * * *